US005210470A

United States Patent [19]

Jones

[11] Patent Number: 5,210,470

[45] Date of Patent: May 11, 1993

[54] LOW POWER ON-OFF CONTROL OF ELECTRONIC BALLAST

[75] Inventor: William H. Jones, Villa Park, Ill.

[73] Assignee: Appliance Control Technology, Inc., Addison, Ill.

[21] Appl. No.: 814,718

[22] Filed: Dec. 30, 1991

[51] Int. Cl.[5] ..... H05B 41/29; H05B 41/36

[52] U.S. Cl. ..... 315/209 R; 315/210; 315/226; 315/DIG. 5

[58] Field of Search ..... 315/209 R, 224, 307, 315/DIG. 4, DIG. 5, DIG. 7, 210, 226

[56] References Cited

U.S. PATENT DOCUMENTS 4,667,131 5/1987 Nilssen ..... 315/307 X
4,893,059 1/1990 Nilssen ..... 315/224 X
4,939,427 7/1990 Nilssen ..... 315/224 X
5,013,974 5/1991 Nilssen ..... 315/DIG. 7 X
5,015,923 5/1991 Nilssen ..... 315/DIG. 5 X

*Primary Examiner*—David Mis
*Attorney, Agent, or Firm*—Robert J. Black

[57] ABSTRACT

An electronic ballast for use with fluorescent lamps including an inverter circuit for converting a direct current power source to a high voltage alternating current and starting means to inhibit operation of one of the inverter transistors until such time as fluorescent lamp is turned on. The circuitry taught eliminates substantial drain usually found at start up of inverter circuits due to the large capacitors usually found in such circuitry.

3 Claims, 1 Drawing Sheet

LOW POWER ON-OFF CONTROL OF ELECTRONIC BALLAST

BACKGROUND OF THE INVENTION

1. Field of the Invention

The present invention is directed to ballast systems for use with fluorescent lighting systems and more particularly to circuitry for turning on and off electronic ballasts requiring only low power drain as opposed to the typical high power surges, usually found in this environment.

2. Background Art

It has been determined that when an electronic ballast is first energized from an alternating current power line, a very large surge of current quickly occurs. This large and usually excessive current flow is because two large (such as 100 microfared) filter capacitors are discharged. With a typical electronic ballast fully discharged (having an ESR of 1.21) a surge current of 50 amps may be experienced.

In those environments where there are particularly a large number of ballasts operated at the same time, for example, 30–36, this may represent capacitance from 6,000 to 7,200 mf. Thus, in such an environment when the lamps are turned on it will cause a current surge of over 100 amperes. Usually a high powered expensive relay must be used to handle such an initial load. The momentary surge current may very well cause a momentary dip or drop in line voltage. This line voltage drop could then adversely affect other equipment on the same branch circuit particularly those items that are critical of such brief changes such as computer terminals and the like. A number of attempts have been made over the years to provide a solution to the aforementioned problem. A representative of such solutions have been noted and set forth in the following U.S. Patents.

U.S. Pat. No. 4,042,855 which issued to Buenzii, Jr. teaches a ballast arrangement with a central rectifying control panel in the high frequency inverter. Included in the high frequency inverter is a low energy switch controlling the operation of the high frequency transistor ballast. A low voltage current limiting remote on off control capability is provided at low cost through a secondary winding on a transformer included in the inverter circuit.

U.S. Pat. No. Re. 31,758 which issued to Nilssen teaches an inverter means wherein are included feedback means operable to prevent premature transistor conduction and a capacitor connected between the collector and inverter transistors operable to restrain the rate of change of transistor collector voltage to minimize energy dissipation. This patent teaches an inverter wherein there are included sensing means and frequency control input means. Sensing means being responsive to the magnitude of the DC voltage to provide an input to the frequency controlling circuitry to cause the magnitude of AC current to remain relatively constant regardless of the periodic variations in magnitude to the DC voltage.

U.S. Pat. No. 4,999,546 which issued to Koda et al teaches a starting device for fluorescent lamp and causes the frequency of the pulses of fixed duty ratio to be adjusted to enable the high voltage applying means of the inverter to apply a high voltage of a frequency proper for pulses to the discharge tube and effect efficient and stable start of the discharge tube, thus providing some power reduction. The patent also teaches sequential starting of the individual tubes in the multiple lamp facility to reduce the power requirements.

To overcome the problems outlined above, the present invention solves the problem by keeping the included large filter capacitors in the ballast fully charged at all times, thus control of the fluorescent lamps is accomplished by starting and stopping the high frequency oscillator means. When the lamp is off a low trickle current is required from the AC line.

SUMMARY OF THE INVENTION

In the usual typical electronic ballast for use with fluorescent lamps, a two transistor inverter circuit is employed wherein a diac will start oscillation by creating a pulse in the base of one of the transistors. This transistor then turns on resulting in current flow into an associated toroidal transformer. At saturation the first transistor turns off and the complementary transistor turns on momentarily with the sequence repeating back and forth into oscillation. To stop oscillation it becomes only necessary to ground the base of the first transistor. Thus, with no trigger pulse arriving from the transformer, the transistor remains in the off condition.

In the present invention an additional transistor is included to clamp the base of the first transistor to its emitter to prevent oscillation. Power to operate the additional transistor is furnished by the power supply of the electronic ballast and is continuously engaged. A number of resistors across the power supply of the rectified output provide a voltage divider network. With this network, a voltage of approximately 20 volts is available with respect to the emitter of the additional transistor. A separate switch connects the midpoint of the resistors to the emitter. Closing the switch takes the voltage away from the base of the transistor after which it will turn off causing the oscillation to start. Thus, the fluorescent lamp is illuminated in the usual way. The voltage provided by the voltage divider ensures there will be sufficient voltage to prevent possible switch contact contamination.

DESCRIPTION OF THE PREFERRED EMBODIMENT

Figure 1:
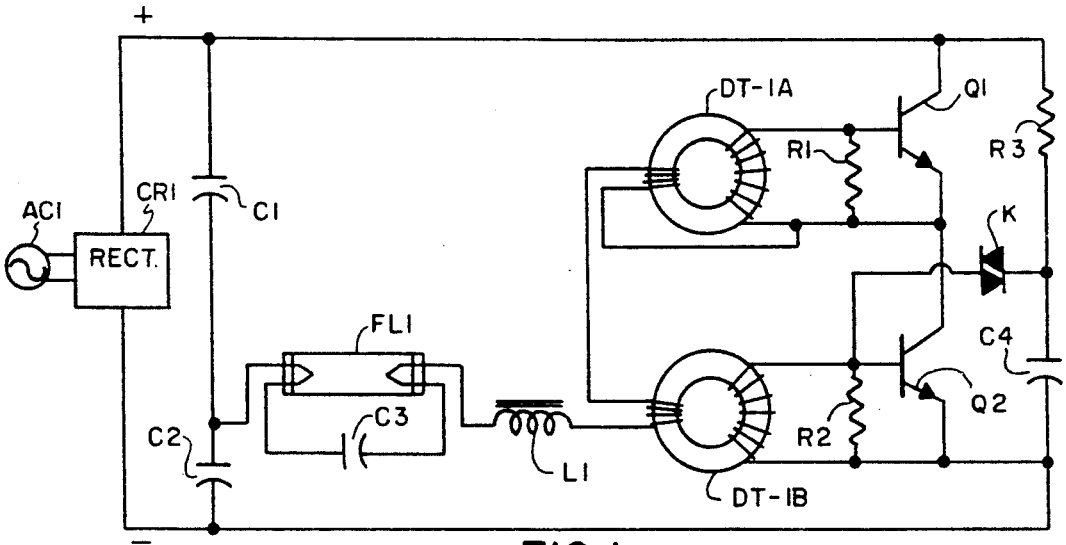
FIG. 1 (PRIOR ART)
FIG. 1 is a prior art figure of a series connected conventional LC type electronic ballast circuit for use with fluorescent lamps.
Figure 2:
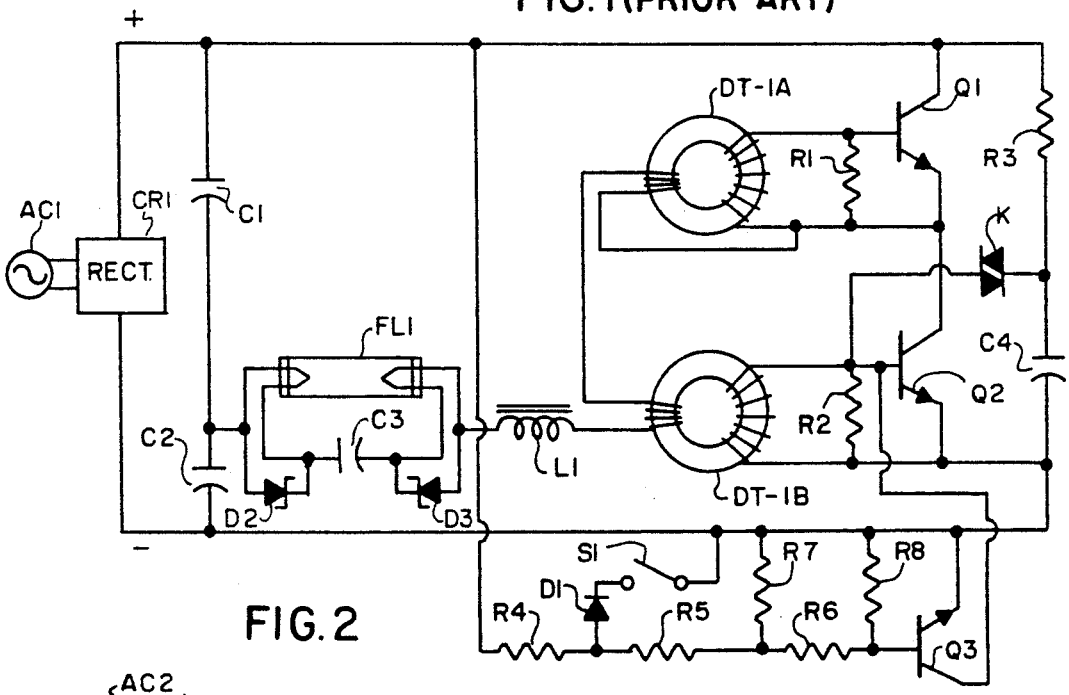
FIG. 2 is a schematic diagram of an electronic ballast modified in accordance with the teachings of the present invention.

As seen in FIGS. 1 and 2, the usual inverter circuitry is shown consisting of transistors Q1, Q2, dual toroids DT-1A and DT-1B, conductor L1, diac D1, fluorescent lamp FL1, a source of AC current AC1, and rectifier CR1. All of the above being the usual parts as well as the appropriate resistors, capacitors and diodes which form a part of a typical LC connected type electronic ballast. Referring to FIG. 2 additional circuitry in accordance with the present invention includes the addition of transistor Q3 which is used to clamp the base of transistor Q2 to its emitter to prevent oscillation. Power to operate transistor Q3 is furnished by the power supply or rectifier section of the electronic ballast which in the present environment is continuously engaged. Resistors R4, R5, and R7 act as a voltage divider network, existing across the positive and negative busses. At the midpoint of resistors R4 and R5, a voltage of 20 volts exists with respect to the emitter of transistor Q3.

A switch S1 connects the midpoint of resistors R4 and R5 to the emitter of transistor Q3. Operation of switch S1 removes voltage from the base of transistor Q3. Transistor Q3 will then turn off as a consequence which then allows oscillation to start by permitting transistor Q2 to function. At this time, the fluorescent lamp FL1 will become illuminated.

20 volts was selected to ensure that there will be sufficient voltage to break down any possible switch contact contamination. As long as appropriate contact material is used any voltage could be utilized in the afore described circuitry. By inclusion of a normally open switch to turn on the fluorescent lamp, a fail safe arrangement is provided. Should the switch contacts become contaminated and an open circuit occurs, the lamp will remain in the off condition.

Figure 3:
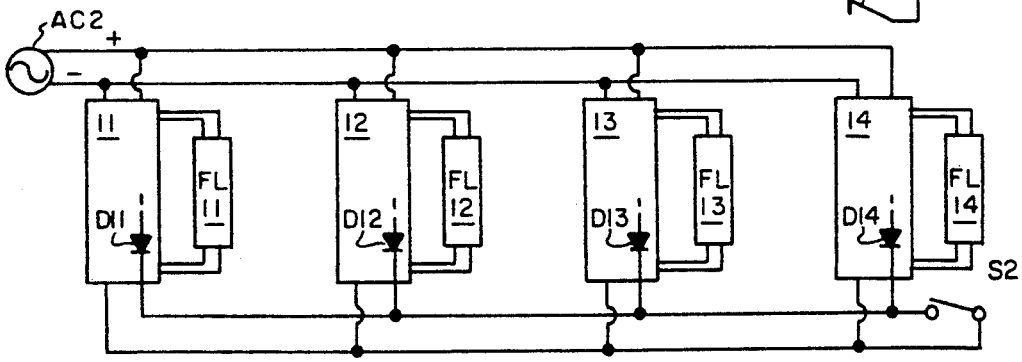
FIG. 3 is simplified schematic diagram of a plurality of electronic ballasts controlled by a single switch in accordance with the teachings of the present invention.

Diode D1 is employed in the conductor to switch S1, particularly if more than one electronic ballast is connected in parallel through a common on/off switch. This arrangement is shown in FIG. 3 wherein ballasts 11, 12, 13 and 14 are shown, each associated with a respective fluorescent lamp FL11, FL12, FL13 and FL14. the included diodes are shown as diodes D11, D12, D13 and D14, respectively, each of which corresponds to diode D1 shown in FIG. 2. However, a single switch S2 is employed to turn on all of the inverter circuits and their associated fluorescent lamps rather than the single switch S1 as shown in FIG. 2.

By eliminating the need for large relays for switching purposes and similar devices, the present invention provides significant economical advantage in those environments where a large number of fluorescent lamps and associated electronic ballasts are required such as in sun tanning lamps. The present invention thus eliminates any voltage dip on starting and greatly increases life of the filter capacitors, as well as the rectifying diodes that previously had to endure the typical large current surges occurring in the usual circuitry.

While by a single embodiment of the present invention has been shown, it will be obvious to those skilled in the art that numerous modifications may be made without departing from the spirit of the present invention which shall be limited only by the scope of the claims appended hereto.

What is claimed is:

1. A first electronic ballast connected to a fluorescent lamp including:

an inverter circuit including connections to a direct current power source for converting direct current to high voltage alternating current;

first and second transistors;

and a dual toroid coil assembly functioning with said transistors to form said inverter circuit;

starting means connected between said direct current power source and said second transistor operated to turn said second transistor on thereby initiating operation of said inverter means;

a low power control circuit;

connected between said power source and said second transistor;

operated to inhibit operation of said starting means to prevent operation of said second transistor;

said low power control circuit including a third transistor connected to said second transistor to ground said second transistor and thereby inhibit operation of said second transistor;

and switching means manually operated to render said third transistor non-operated whereby said second transistor is conditioned for operation and in response to said starting means said second transistor is rendered operated.

2. An electronic ballast as claimed in claim 1 wherein: said starting means comprise a diac.

3. An electronic ballast as claimed in claim 1 wherein: there is further included a plurality of additional electronic ballasts each connected to a different fluorescent lamp;

each of said additional ballasts including an inverter circuit for converting direct current to high voltage alternating current; first and second transistors; starting means; and a dual toroid coil assembly functioning with said transistors to form said inverter circuits;

each of said additional ballasts further including a low power control circuit and a third transistor circuit operated to inhibit said included starting means from rendering said included second transistor operated;

each of said additional ballasts including a circuit connection to said switching means associated with said first electronic ballast;

each of said low power control circuits operated in response to manual operation of said switching means whereby said included third transistor circuits are disabled said included second transistors are rendered operated.

* * * * *